United States Patent [19]

Bracy

[11] Patent Number: 4,817,808

[45] Date of Patent: Apr. 4, 1989

[54] TABLE-TOP RECEPTACLE FOR STORING PREPARED FOOD ITEMS

[76] Inventor: Bonnie Bracy, P.O. Box 163, Hwy. 1207, Enfield, N.C. 27823

[21] Appl. No.: 150,900

[22] Filed: Feb. 1, 1988

[51] Int. Cl.[4] ..... B65D 1/22

[52] U.S. Cl. ..... 220/20

[58] Field of Search ..... 220/20, 22; 312/327, 312/328

[56] References Cited

U.S. PATENT DOCUMENTS 2,792,961 5/1957 Gordon ..... 220/20

4,543,798 10/1985 Page ..... 220/20 X

*Primary Examiner*—Donald F. Norton

*Attorney, Agent, or Firm*—Rhodes, Coats & Bennett

[57] ABSTRACT

A picnic accessory comprises a receptacle whose interior is divided by a plurality of walls into discrete food bins capable of storing and receiving food items. Each food bin has a movable lid associated therewith for protecting the stored food item from ambient conditions. The lid is movable from a first position in which the associated food bin is closed to a second position in which the associated food bin is open so that access can be made to the stored food item. The lid for each food bin is biased by gravitational forces to the closed position so that the stored food items will not be inadvertently left exposed.

8 Claims, 1 Drawing Sheet

TABLE-TOP RECEPTACLE FOR STORING PREPARED FOOD ITEMS

FIELD OF THE INVENTION

The present invention relates generally to food storage devices and more particularly to picnic accessories for temporarily storing prepared food items.

BACKGROUND OF THE INVENTION

Outdoor dining is a commonplace form of social interaction in the United States which perhaps began as early as the first Thanksgiving dinner. This custom has continued until the present despite a number of nuisances which detract from the enjoyment. Whenever food is placed outdoors, there is always a risk of contamination by flying and crawling insects. Also, many outdoor dinners have been ruined by sudden bursts of rain or other forms of precipitation. These nuisances have always been tolerated in the past.

Portable food storage containers for carrying food are known in the art. These cases are generally insulated to maintain a constant temperature and sometimes include a heating or cooling element. Two such devices are described in U.S. Pat. Nos. 3,805,018 and 3,915,304. Such devices are typically designed for individual servings and are not suitable for large family gatherings where a large number of prepared food items need to be protected from ambient conditions.

SUMMARY AND OBJECT OF THE INVENTION

The present invention was developed to provide a multi-compartmented receptacle for storing and protecting a plurality of prepared food items from ambient conditions. The receptacle includes a centrally disposed wall which divides the receptacle into front and rear compartments. These front and rear compartments of the receptacle are then divided by a plurality of walls into numerous laterally adjacent food bins capable of receiving and storing prepared food items. A lid is operatively associated with each individual food bin for permitting or denying access to the associated food bin. When in a closed position, the lid protects the stored food item from contamination by flying and crawling insects as well as from ambient conditions such as rain. In order to gain access to the stored food item, the lid is raised to an open position with one hand while the food item is served with the other. When the lid is released, it will return by gravitational force to its closed position assuring that the lid will not be inadvertently left open.

From the foregoing, it is apparent that the primary object of the present invention is to provide a multi-compartmented receptacle for storing a plurality of prepared food items and protecting the stored food items from contamination by flying and crawling insects.

It is another object of the present invention to provide a receptacle for protecting the stored food items from ambient conditions such as rain.

It is another object of the present invention to provide a receptacle for conveniently storing utensils and other supplies needed for serving and eating the stored food items.

It is also an object of the present invention to provide a receptacle for storing prepared food items which is easily transported to the location where the prepared food items are to be served.

It is another object of the present invention to provide a receptacle for storing prepared food items, having a simple but durable construction capable of withstanding years of use.

Still another object of the present invention is to provide a receptacle for storing prepared food items whose surfaces are relatively easy to clean and which requires little or no maintenance.

Other objects and advantages of the present invention will become apparent and obvious from a study of the following description and the accompanying drawings which are merely illustrative of such invention.

DETAILED DESCRIPTION OF THE INVENTION

Figure 1:
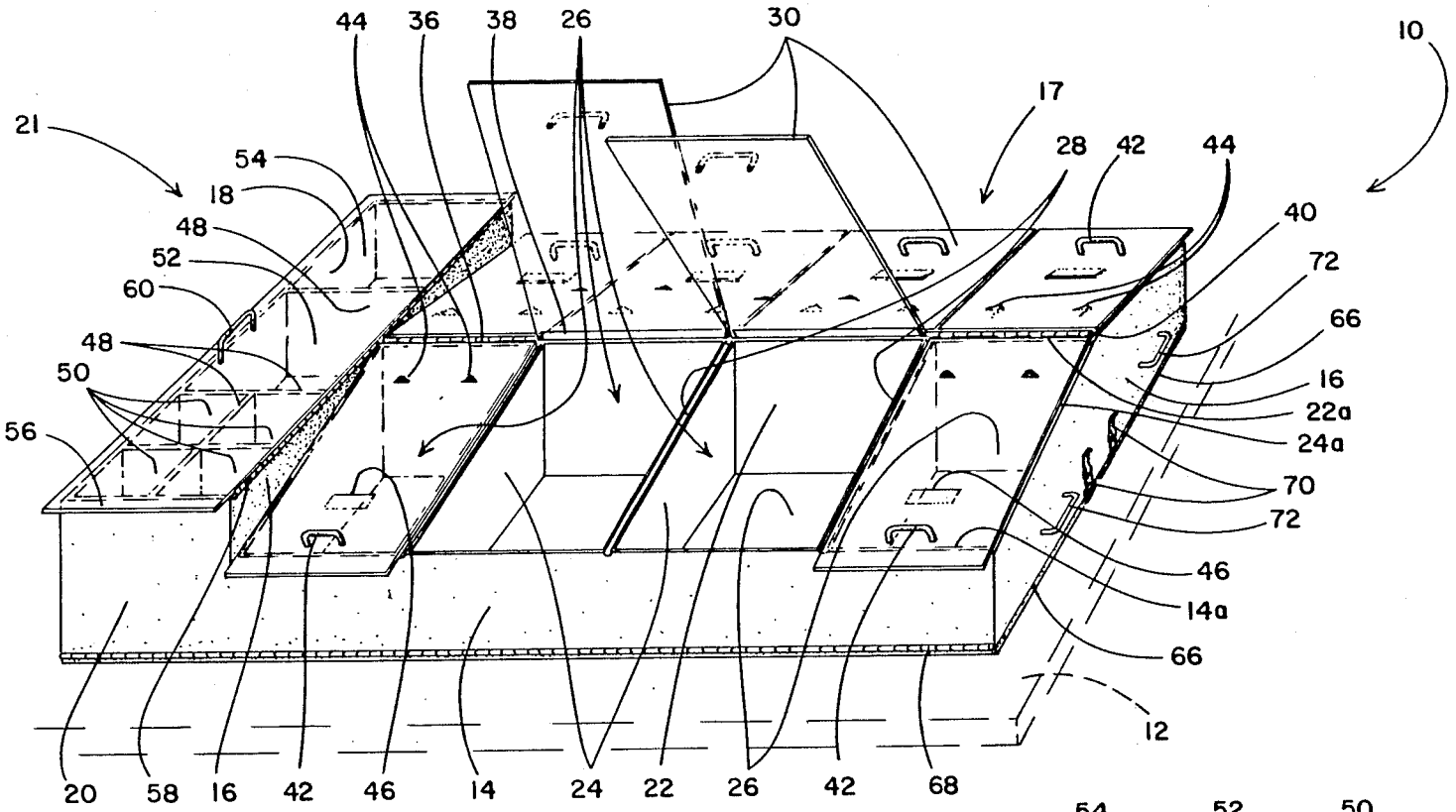
FIG. 1 is a perspective view of the multicompartmented receptacle of the present invention.

Referring now to the drawings, the multicompartmented receptacle of the present invention is shown therein and indicated generally by the numeral 10. In the preferred embodiment, the receptacle 10 is supported by the top of a table 12 on which the prepared food items would ordinarily be arranged. The receptacle 10 could be made in a number of shapes and dimensions. However, a substantially rectangular receptacle 10 which can be accommodated by an ordinary picnic type table would seem to have greater utility to a wider number of users.

The receptacle 10 comprises two parallel side walls 14 and two parallel end walls 16 joined to form a substantially rectangular enclosure. The area between the side walls 14 and end walls 16 forms the food storage section 17 of the receptacle 10. In the preferred embodiment of the invention, the side walls 14 are extended beyond one end wall 16 by side wall extensions 20 which are joined at their outer edges by wall 18. The area defined by wall 18 and the side wall extensions 20 forms the utensil storage section 21 of the receptacle 10.

Within the food storage section 17 of the receptacle 10, there is a hinge wall which extends between the end walls 16 parallel to the side walls 14. As depicted in the illustrations, the hinge wall 22 is disposed midway between the side walls 14 and divides the food storage section of the receptacle 10 into front and rear compartments. Dividing walls 24 having one edge secured to the hinge wall 22 and the opposite edge secured to a respective side wall 14, divides the front and rear compartments of the food storage section into a plurality of food bins 26. In the preferred embodiment of the invention, the hinge wall 22 is taller than the side walls 14. The dividing walls 24 have a trapezoidal configuration with a top edge **24*a* that extends from the top edge 22*a* of the hinge wall to the top edge 14*a* from the side walls 14. A gutter 28 is formed in the top edge 24*a* of the dividing walls 24 to facilitate draining of rain water as will be hereinafter described. The top edges of the end walls 16 also include gutters 28**.

The food bins 26 are sized to receive and store containers of food, such as casserole dishes and plates, containing food items prepared at a remote location. The food container can be placed into the food bins 26 through the open top. In order to protect the food items from contamination by insects and from ambient conditions, a lid 30 is operatively associated with each food bin 26 and is movable between and open and closed position. The lid 30 includes a rectangular top panel 32 having one edge of which is secured to an elongated hinge 36 extending along the top edge of the hinge wall 22. Hinge 36 includes a plurality of independentally operable hinge segments 38 all of which pivot about a single axis 40. Each lid 30 is connected to a separate hinge segment 38 so as to freely pivot in a vertical plane about axis 40 between an open position and a closed position In the closed position, the side edges of the top panel 32 align with respective gutters 28, so that water running over the side edges will drain through gutters 28. Also, because hinge wall 22 is taller than side walls 14, the lids 30 will be sloped when closed so as to shed rainwater from the receptacle. The gutters 28 and slope of the lid 30, assure that water will not infiltrate the food bins 26. If necessary, downwardly depending flanges may be joined to the edges of the top panel 32 to prevent infiltration of water by cohesion along the underside of the top panel 32.

In the preferred embodiment of the invention, the lids 30 are constructed of Plexiglas or other transparent material so that the food items stored in the food bins 26 can be viewed without opening the lid 30. A handle 42 is provided along the lower edge of each lid 30 opposite the hinge 36 for raising the lid 30 to gain access to the stored food item. Each lid 30 is also provided with a series of dormer type ventilation openings 44 allowing water vapor to escape the food bin 26, thus, reducing the amount of condensation that accumulates on the underside of the lids 30. Also, if opaque lids 30 are used, it is desirable to incorporate a card slot 46 into the surface of the lid 30 for retaining a card identifying the food item which is stored in the associated food bin 26. This will eliminate the need to open the lid 30 to view the stored food item which is not desired.

Referring now to the utensil storage area 21 of the receptacle 10, the same is divided by a plurality of interior walls 48 into a plurality of compartments. The compartments 50 can be used to store eating utensils such as knives, forks, and spoons. The compartment 52 is sized to retain napkins, while compartment 54 is sized to retain plates. Compartments 50, 52, and 54 are covered by a lid 56 which is secured to one end wall 16 by a piano type hinge 58. A handle 60 is provided along the edge opposite hinge 58 for opening lid 56 to gain access to the compartments 50, 52, and 54.

In end wall 18 there are formed drawer openings (not shown) into which storage drawers 62 are received. The storage drawer 62 includes separate pulls 64 for opening and closing the drawers. The drawers 62 slide into the space beneath compartments 52 and 54 and provide additional storage space for miscellaneous articles not otherwise provided for.

The receptacle 10 is supported on a table top 12 as shown in FIG. 1. In many instances, the receptacle 10 may cover most of the surface area of the table top so there is no space left for placing a plate while food is being served from the receptacle 10. In such circumstances, the present invention is provided with two bottom panels 66 secured to respective side walls 14 by piano type hinges 68. A latch 70 is also provided for retaining the bottom panel 66 in a closed position as shown in FIG. 1.

Figure 2:
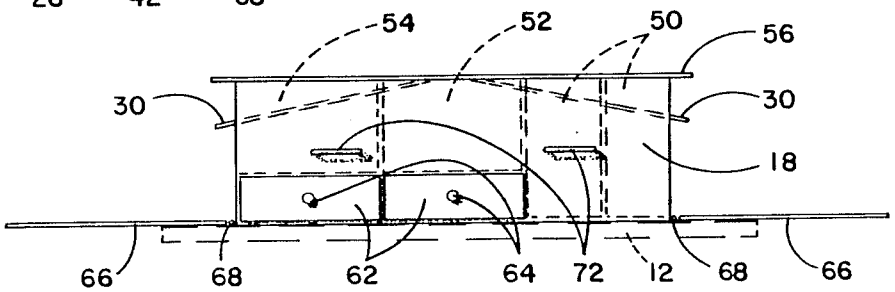
FIG. 2 is an elevation view thereof.

When additional space is needed, the panels 66 can be unlatched and swung to an extended position as shown in FIG. 2, thus, forming a ledge on which plates or other articles can be supported. In the simpliest embodiment of the invention, the bottom panels 66 will be supported in the extended position by the top of table 12. Thus, in order to make use of the bottom panel 66, there must be approximately two to three inches of table top on either side of the receptacle in order to provide sufficient support for the bottom panel 66. In more complex embodiments, braces and locking mechanisms can be employed to retain the bottom panels in the extended position even without support of the table top.

To facilitate carrying the receptacle 10, the receptacle 10 is provided with carrying handles 72 on one end wall 16 and on the wall 18. It is desirable, therefore, to construct the receptacle 10 from plastics or other lightweight materials. Such materials can be easily molded and shaped by methods well known to those skilled in the art.

To use the receptacle 10 of the present invention, it is first placed on the top of a table. If necessary, the bottom panel 66 can be pivoted about the hinges 68 to its extended position to form a ledge on which the plates or other articles can be rested. Food items prepared at a remote location are then brought in their own containers, such as casserole dishes, to the site where to receptacle 10 is located. The food item, and its container, are placed in one of the food bins 26. This is done by grasping the handle 42 of lid 30 and raising the lid 30 to an open position. The prepared food item and its container can then be inserted through the open top into the food bin 26. When the handle 42 is released, the lid 30 will return by the force of gravity to its closed position due to the configuration of the container. This assures that the lid 30 will not be inadvertently left open, thus, exposing the food to contamination. Utensils, plates, and napkins are stored in their respective compartments 50, 52, and 54.

It is contemplated that each person will serve his own plate. Thus, the person must first open the lid 56 of the utensil storage section and remove a plate, napkin, and other utensils which are needed. The person can move around the receptacle 10 to the food bin 26 containing the desired food item. At this point, the plate can be placed upon the bottom panel 66. With one hand the person can lift the lid 30 and serve the prepared food item with the other hand. The person will move to each individual food bin 26 until each desired food item has been served.

From the foregoing, it is apparent that the present invention provides means for protecting the food from potentially contaminating conditions. In the event of rain or other precipitation, water will be shed from the sloped surfaces of the lid 30. The gutters 28 and the downwardly depending flanges 34 will assure that the water does not infiltrate into the food bins 26.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A compartmented, table-top receptacle for storing a plurality of prepared food items, said receptacle comprising:

(a) a wall structure including two side walls and two end walls defining an enclosed area with an open top;

(b) a centrally disposed hinge wall extending between said end walls parallel to said side walls for dividing said enclosed area into two adjacent compartments;

(c) a plurality of dividing walls, each of which extends between said hinge wall and said side walls for dividing said adjacent compartments into a plurality of laterally adjacent food bins capable of receiving and storing food items;

(d) a plurality of closure means, each operatively associated with a respective food bin for closing said food bins to protect the stored food items from ambient conditions; and (e) each said closure means comprising a top panel pivotally secured to said hinge wall and movable between a first position in which the associated food bin is closed and a second position in which the associated food bin is open.

2. The receptacle of claim 1 wherein said top panels slope downwardly from the said hinge wall to said side walls to allow rainwater to run off said top panels.

3. The receptacle of claim 2 including an elongated segmented hinge secured to the hinge wall for pivotally mounting said top panels to said hinge wall such that each top panel is independently movable between its first and second positions.

4. A compartmented, table-top, receptacle for storing a plurality of prepared food items, said receptacle comprising:

(a) a cabinet structure including two substantially parallel side walls having two substantially vertical side edges and a top edge two substantially parallel end walls having substantially vertical side edges and a top edge, the side edges of the end walls being joined with the side walls to form a substantially rectangular enclosure having an open top for storing prepared food items;

(b) a hinge wall extending between the end walls of the cabinet structure parallel to the side walls for dividing the rectangular enclosure into two adjacent compartments, the hinge wall including two substantially vertical side edges and a top edge, the side edges of which are joined to respective end walls approximately midway between the side walls;

(c) wherein the top edge of the hinge wall extends above the top edge of the side walls and wherein the top edge of the end walls include front and rear portions which slope downwardly from the top edge of the hinge wall to the top edge of respective side walls;

(d) a plurality of partition walls extending between the hinge wall and the side walls for dividing the two adjacent compartments of the cabinet structure into a plurality of laterally adjacent food bins capable of receiving and storing food items, each partition wall including two substantially vertical side edges one of which is joined with the hinge wall and one of which is joined with a respective side wall, the partition wall further including a top edge which slopes downwardly from the top edge of the hinge wall to the top edge of a respective side wall;

(f) an elongated, segmented hinge secured to the upper edge of the hinge wall;

(g) closure means operatively associated with each food bin for closing a respective food bin to protect the stored food item from ambient conditions, said closure means including a plurality of top panels each of which includes an inside edge, an outside edge, and two side edges said top panel being by its inside edge secured to an independently operable segment of said hinge by its inside edge so as to be movable between a first closed position in which the top panel slopes downwardly from the top edge of the hinge wall to the top edge of a respective side wall and a second position in which the associated food bin is open.

5. The receptacle of claim 4 wherein said partition walls include a gutter formed along its top edge and wherein said closure means includes flanges depending downwardly from the side edges of said top panel into said gutters for preventing infiltration of water into said food bins.

6. The receptacle of claim 4 wherein said cabinet structure further includes a wall extending parallel to said end walls and having substantially vertical side edges joined with the side walls to form a second substantially rectangular enclosure having an open top for storing eating utensils.

7. The receptacle of claim 6 wherein the second rectangular enclosure is divided into a plurality of compartments by dividing walls.

8. The receptacle of claim 7 further including a second closure means for closing the second rectangular enclosure, said second closure means including a lid movable between a first in which said second rectangular enclosure is closed and a second position in which said enclosure is open.

* * * * *